US005743695A

United States Patent [19]

Ryu

[11] Patent Number: 5,743,695

[45] Date of Patent: Apr. 28, 1998

[54] AUTOMATIC CHIP-LOADING APPARATUS

[75] Inventor: Do Hyun Ryu, Kyungsangbuk-do, Rep. of Korea

[73] Assignee: LG Semicon Co., Ltd., Chungcheongbuk-do, Japan

[21] Appl. No.: 493,457

[22] Filed: Jun. 23, 1995

[30] Foreign Application Priority Data

Jun. 24, 1994 [KR] Rep. of Korea ..... 14610/1994

[51] Int. Cl.[6] ..... B07C 5/344

[52] U.S. Cl. ..... 414/222; 414/331; 414/404; 414/416; 414/935

[58] Field of Search ..... 414/222, 331, 414/404, 416, 797.4, 797.5, 797.9, 935

[56] References Cited

U.S. PATENT DOCUMENTS

| | | | |
|---|---|---|---|
| 4,556,362 | 12/1985 | Bahnck et al. | 414/935 X |
| 4,588,342 | 5/1986 | Hirokawa et al. | 414/797.4 |
| 4,651,863 | 3/1987 | Reuter et al. | 414/331 X |
| 4,712,963 | 12/1987 | Kondo | 414/331 X |
| 4,818,169 | 4/1989 | Schram et al. | 414/416 X |
| 4,907,701 | 3/1990 | Kobayashi et al. | 414/416 X |
| 5,150,797 | 9/1992 | Shibata | 414/416 X |
| 5,203,661 | 4/1993 | Tanita | 414/331 |
| 5,302,078 | 4/1994 | Essick et al. | 414/797.9 X |
| 5,313,156 | 5/1994 | Klug et al. | 414/416 X |

FOREIGN PATENT DOCUMENTS

| | | | |
|---|---|---|---|
| 5183022 | 7/1993 | Japan | 414/935 |
| 5286521 | 11/1993 | Japan | 414/331 |

*Primary Examiner*—James W. Keenan

[57] ABSTRACT

An automatic chip-loading apparatus including a wafer loading mechanism on which a wafer with sawed chips is loaded; a tray loading/unloading mechanism installed on one side of the wafer loading mechanism for loading empty trays and unloading trays with chips; a tray carrying mechanism for taking out an empty tray from the tray loading/unloading mechanism and loading the tray on the tray loading/unloading mechanism when a predetermined number of chips are mounted on the empty tray; and a chip carrying mechanism for carrying chips selected from the wafer onto an empty tray taken out from the tray loading/unloading mechanism.

21 Claims, 15 Drawing Sheets

AUTOMATIC CHIP-LOADING APPARATUS

BACKGROUND OF THE INVENTION

The present invention relates to an automatic chip-loading apparatus for automatically loading a plurality of chips from a sawed wafer onto a tray, and more particularly, to an automatic chip-loading apparatus in which only sawed good chips are selected and loaded on an empty tray automatically dispensed from a plurality of empty trays and, after loaded with good chips, stored in an loading/unloading device.

FIGS. 1A, lB and 2 are front, plan, and side views of a conventional chip-loading apparatus. On the top center of a base 1, a rotation table 3 (on which a sawed wafer 2 is loaded) is installed to be movable along with X and Y axes. A camera 4 for discriminating whether respective sawed chips are good or bad is installed directly above the rotation table 3. In the rear of the rotation table 3, a pickup 5 for carrying good chips to the trays 9 is installed to be rotatable within a range of 0° to 180°. In the rear of base 1, an X-axis robot 7 is secured to a fixed mount 6. An Y-axis robot 8 is coupled to the X-axis robot 7. A tray base 10 with a plurality (8) of trays 9 is fixed to the Y-axis robot.

Wafer 2, sawed in unit chips, is loaded on rotation table 3, and at the same time, each of the trays 9 is mounted on respective depressions formed in tray base 10. In this state as power is applied to operate the apparatus and to move the rotation table 3 along the X and Y axes, camera 4 installed directly above the rotation table 3 discriminates whether the sawed chips are good or bad. If the chips are good, the pickup 5 loads each good chip on one of the trays 9.

When one chip is loaded on one of the trays 9, the loaded tray is shifted by X- and Y-axes robots 7 and 8, and the rotation table 3 also moves. Other chips regarded as good can be loaded sequentially and as the trays 9 are shifted.

After all of the chips are loaded on the trays 9 as mounted on tray base 10, each tray holding a chip is separated from tray base 10 and transferred to another location by an operator. The empty tray is remounted on the tray base 10 so that the above-explained process is repeated.

However, in this conventional apparatus, the working time is elongated resulting in reduced productivity because the operator must manually replace the trays 9 each time the trays 9 become filled.

SUMMARY OF THE INVENTION

Therefore, in order to overcome such a problem, it is an object of the present invention to provide an automatic chip-loading apparatus which automatically selects the good chips and places them on an empty tray, without having to manually replace loaded trays.

To accomplish the object of the present invention, there is provided an automatic chip-loading apparatus comprising: a wafer loading mechanism on which a wafer with sawed chips is loaded; a tray loading/unloading mechanism installed on one side of the wafer loading mechanism and for loading empty trays and unloading trays filled with chips; a tray carrying mechanisms for taking out an empty tray from the tray loading/unloading mechanism and loading the tray on the tray loading/unloading mechanism when a predetermined number of chips are mounted on a tray; and a chip carrying mechanism for carrying chips selected from the wafer and placed onto an empty tray.

The wafer loading mechanism is installed on a base and cooperates with other components in the loading process. A wafer to be sawed into chips is mounted on the wafer loading mechanism.

The tray loading/unloading mechanism comprises: a first magazine on which empty trays are mounted sequentially; a first transfer installed adjacent to the first magazine for separating the lowest empty tray from a plurality of trays stored in the first magazine; a third cylinder installed under the first magazine for holding empty trays stacked above the lowest tray one as the first transfer separates the lowest empty tray; a second magazine for loading trays filled with chips; and a second transfer installed adjacent to the second magazine for loading trays filled with chips into the second magazine.

The chip carrying mechanism comprises: a pickup block moving laterally within a predetermined rotation range, and a pickup fixed to the front end of the pickup block and for adsorbing and moving chips.

The tray carrying mechanism comprises: an X-Y robot fixedly installed to the base; a tray base fixed to the X-Y robot and moving laterally as the X-Y robot is driven, and on which one empty tray is mounted from the tray loading mechanism; and a clamp elastically installed to be movable with respect to the tray base and for clamping the empty tray mounted.

BRIEF DESCRIPTION OF THE ATTACHED DRAWINGS

These and other features, aspects, and advantages of the present invention will become better understood with regard to the following description, appended claims, and accompanying drawings, where:

DETAILED DESCRIPTION OF THE INVENTION

Hereinafter, a preferred embodiment of the present invention will be described below with reference to the attached drawings.

Figure 1A:
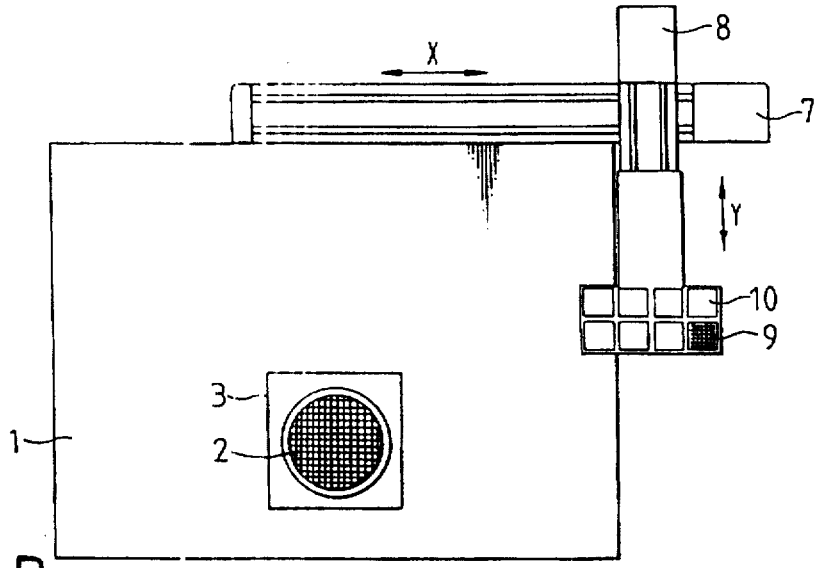
FIG.1A prior art
FIGS. 1A and 1B are front and plan views of a conventional chip-loading apparatus, respectively.
Figure 1B:
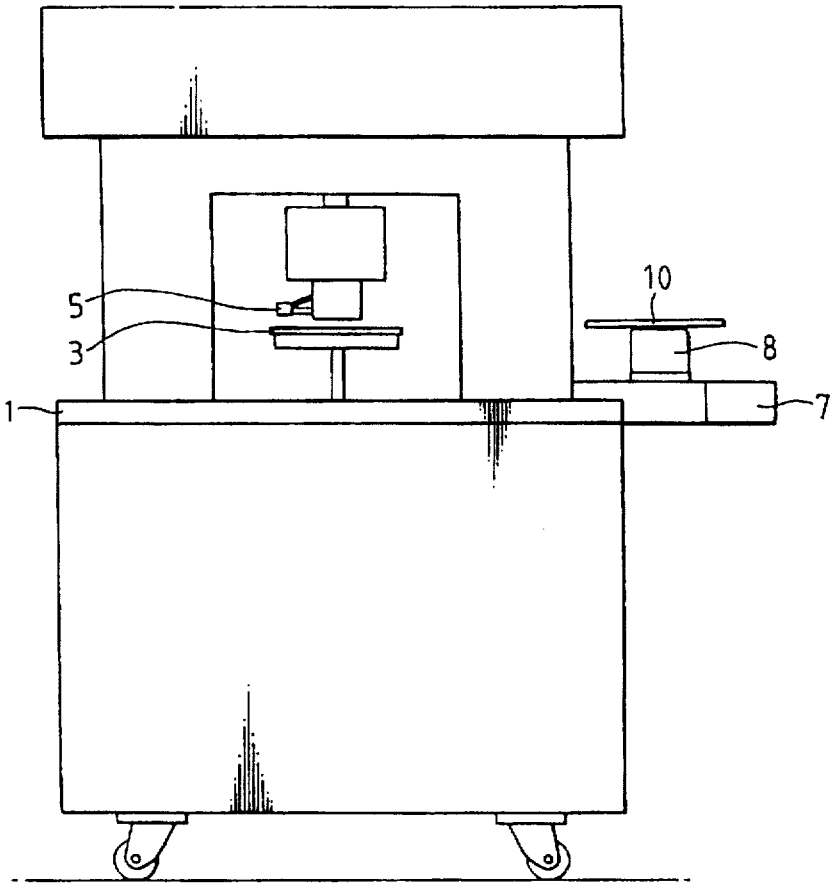
FIG.1B prior art
Figure 2:
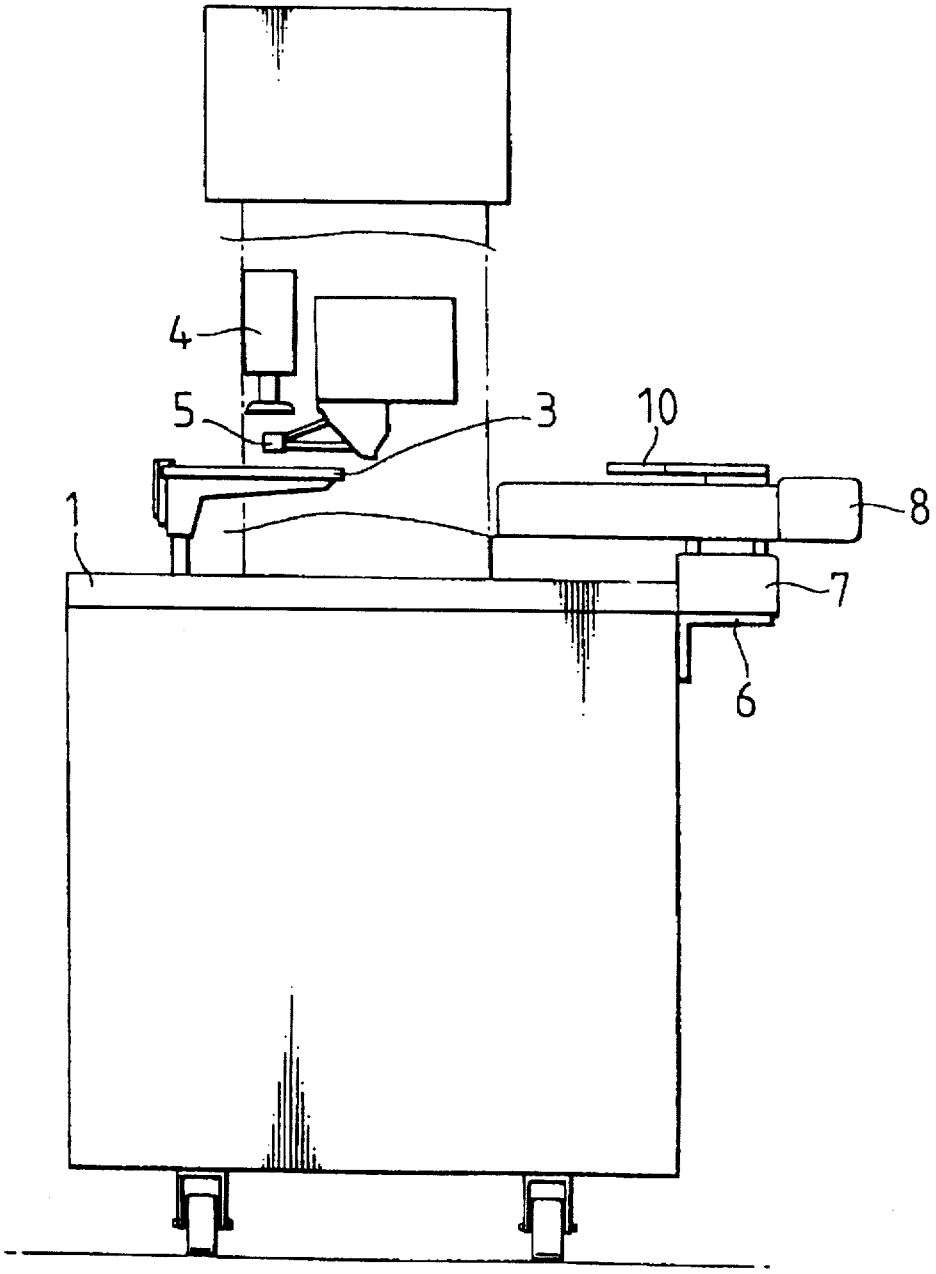
FIG .2 prior art
FIG. 2 is a right-side view of the conventional apparatus of FIG. 1.
Figure 3:
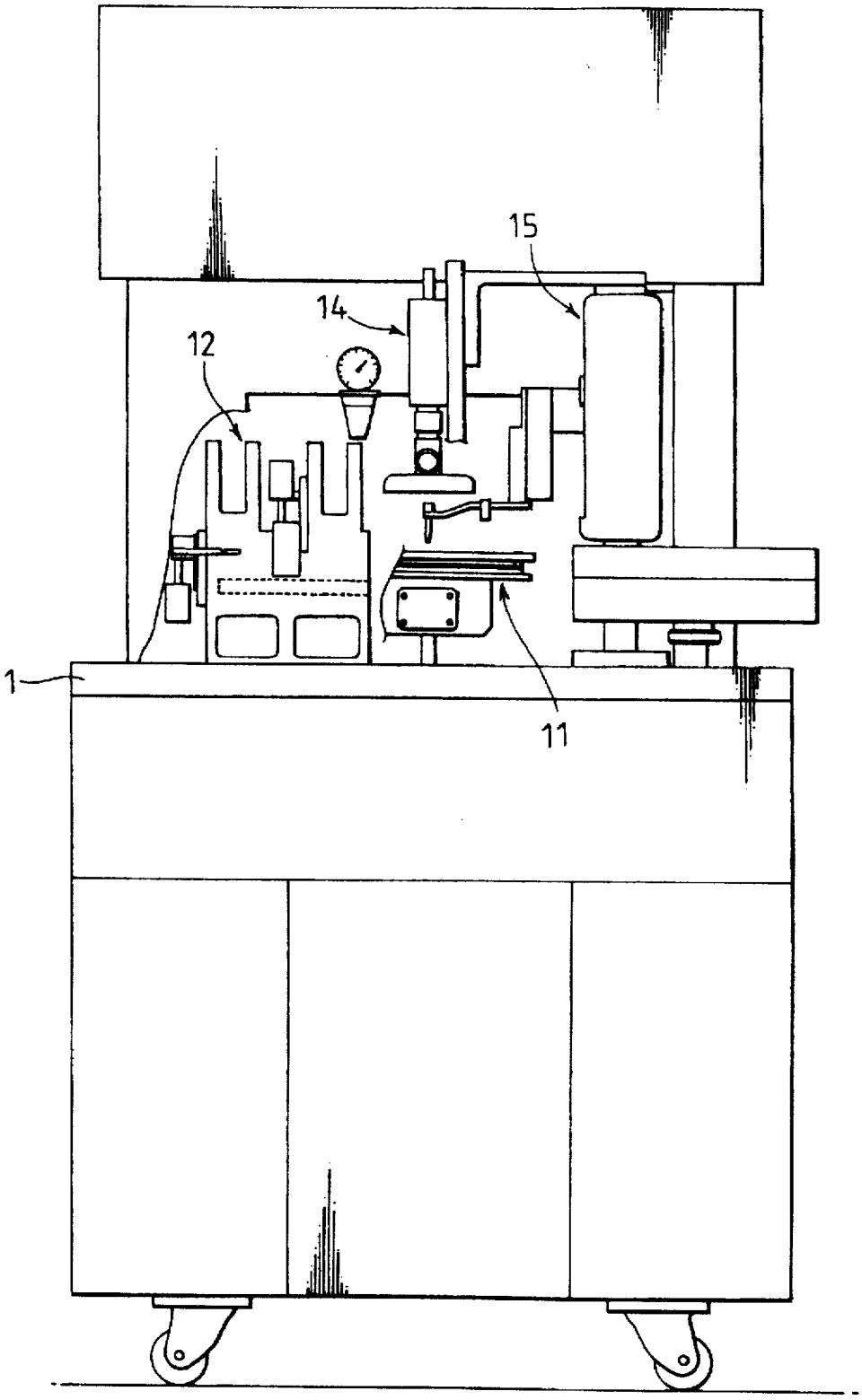
FIG. 3 is a front view of an automatic chip-loading apparatus according to one preferred embodiment of the present invention.
Figure 4:
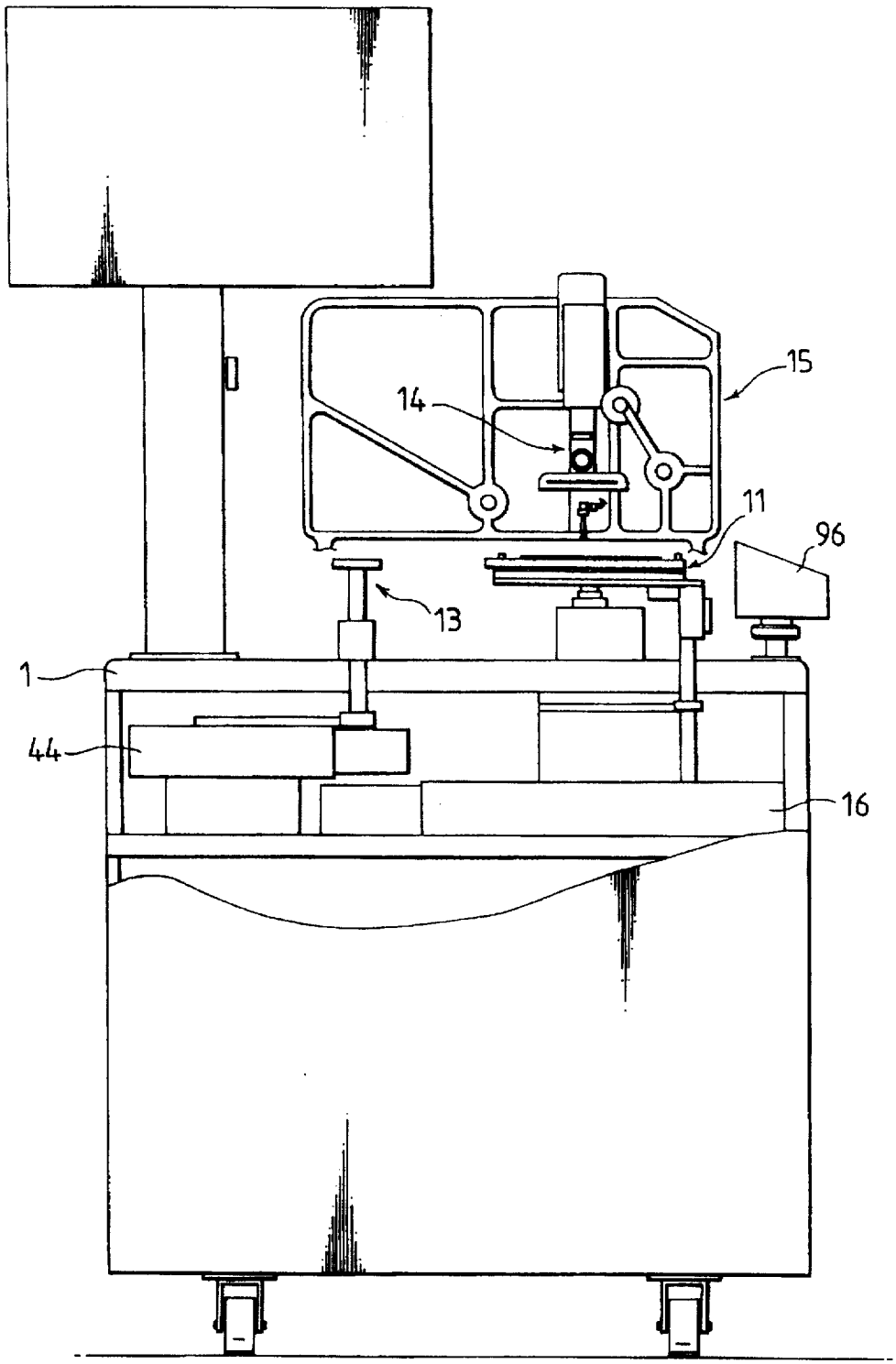
FIG. 4 is a side view of the apparatus of FIG. 3 in which part of the components of FIG. 3 are omitted.

Referring to FIGS. 3 and 4, the automatic chip-loading apparatus of the present invention comprises a wafer loading portion 11 installed on the top center of a base 1 for loading a sawed wafer 2 (see FIG. 5*a*), a tray loading/unloading portion 12 on which empty and loaded trays 9 are sequentially loaded, a tray carrying portion 13 for carrying the trays to the tray loading/unloading portion 12 or to a position where the chips are loaded, a camera 14 for discriminating whether the chips loaded on the wafer loading portion 11 are good or bad, and a chip carrying portion 15 for picking good chips and carrying them to the tray mounted on the tray carrying portion 13. This preferred embodiment of the invention is roughly divided into five parts.

The wafer loading portion 11 will be explained in detail with reference to FIGS. 5A, 5B, and 5C.

An X-Y robot 16 is fixed to base 1. A rotate mount 18 is secured to the shaft 17 of the X-Y robot 16. A bolt 20 is fastened to mount clamp 19. Bolts 20 are tightened to secure the rotate mount 18. A base mount 21 for supporting the rotate mount 18 so as not to tilt under its own weight when the position of the rotate mount 18 is adjusted, is coupled to the shaft 17 of the X-Y robot 16 placed under rotate mount 18. The position of base mount 21 is determined by the tightening force of bolts 22.

An expander table 23 divided into a movable expander table **23*a* and fixed expander table 23*b* is installed above rotate mount 18. Lead screws 25 being rotated by the step motor 24 to rotate mount 18 which is screw-fastened to movable expander table 23*a*. An expander ring 27 connected to a foil 26 to which wafer 2 is attached is fixedly installed on fixed expander table 23*b*. Expander ring 27 expands the foil 26 attached to a frame 28 as the movable expander table 23*a* is lowered by driving of the step motor 24. Here, lead screws 25 coupled to the edges of movable expander table 23*a* must be constructed to rotate in the same direction as the direction in which the step motor 24** is driven.

Figures 6A, 6B:
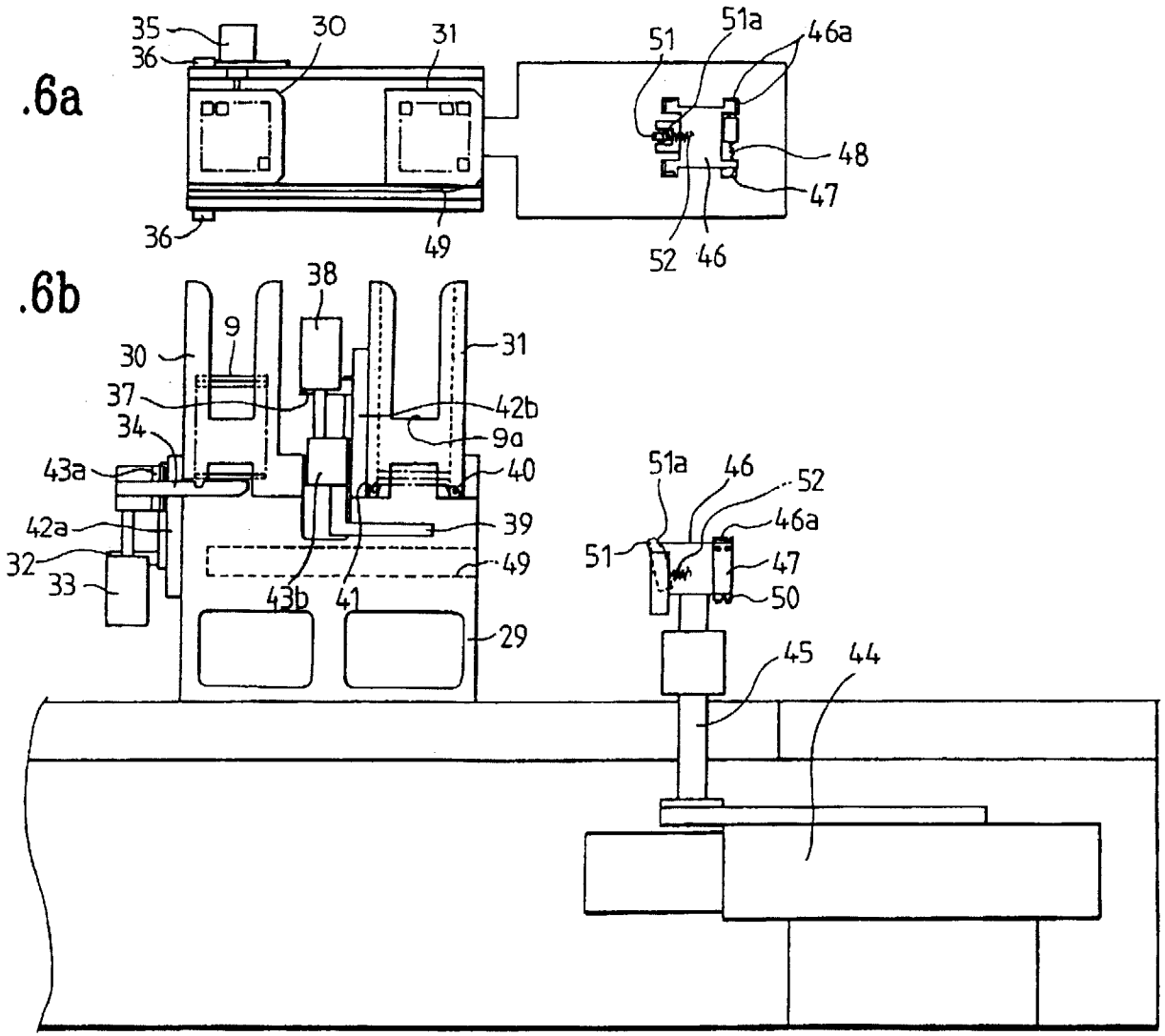
FIGS. 6A and 6B are plan and front views of the tray loading/unloading portion and tray carrying portion of one preferred embodiment of the present invention, respectively.

Referring to FIGS. 6A and 6B, a main support 29 is fixed in front (the direction opposite to an operator) of base 1. A first magazine 30 into which empty trays 9 are mounted sequentially is installed on one side of the main support 29. A second magazine 31, into which trays **9*a* with chips mounted thereon are sequentially stacked, is installed on the other side of the main support 29**.

A first cylinder 33 is supported by a bracket 32 under first magazine 30. A first transfer 34 is installed adjacent to first cylinder 33. First transfer 34 is raised by the operation of the first cylinder 33 to separate the empty trays 9 in first magazine 30 one at a time to sequentially supply them to tray carrying portion 13. A third cylinder 35 is installed under the other side of the first magazine, and operates just before the first transfer 34 separates the lowest empty tray 9, so as to hold an empty tray 9 placed above the lowest tray 9. Therefore, third cylinder 35 prevents empty trays 9 beginning with the next to the lowest tray 9 in the stack from falling due to their own weight.

A pair of sensors 36 are installed on opposing sides of first magazine 30. They are designed to detect whether more than one tray 9 is mounted or not on the first transfer 34 when the first transfer 34 is lowered by first cylinder 33 to separate the lowest empty tray from the first magazine 30 in the state in which the third cylinder 35 holds the next to the last empty tray 9. For this operation, sensors 36 must be installed to be located directly above a place where the empty tray 9 mounted on the first transfer 34 is positioned when the first transfer 34 is placed at the minimum-range point. More, the sensors 36 detect whether one or more empty trays 9 are present when first transfer 34 is placed at the minimum-range point. In other words, if sensors 36 do not detect any empty tray 9 when the first transfer 34 is placed at the minimum-range point, it is determined that one empty tray 9 is mounted on the first transfer. In this state, the CPU continues to perform a subsequential process. Conversely, if the sensors 36 detect an empty tray 9, it is determined that more than one tray is mounted on the first transfer 34. In this situation, the CPU stops operating the system indicates this situation to the operator by a buzzer or alarm lamp.

A second cylinder 38 is supported by a bracket 37 under second magazine 31. A second transfer 39 is installed to the rod of second cylinder 38. The second transfer 39 is raised or lowered by the second cylinder 38 to sequentially put trays holding chips into second magazine 31. A stop 40 for preventing trays **9*a* held in second magazine 31 from falling is installed and elastically supported by a coil spring 41 with a tray receiving channel of the second magazine 31. Stop 40 retracts as the trays 9*a* are loaded into the second magazine. Guide blocks 42*a* and 42*b* are fixed to the first and second magazines 30 and 31 so that first and second transfers 34 and 39 move vertically and stably. Coupling pieces 43*a* and 43*b* fitted into the guide blocks 42*a* and 42*b* are secured on first and second transfers 34 and 39**.

Figure 7:
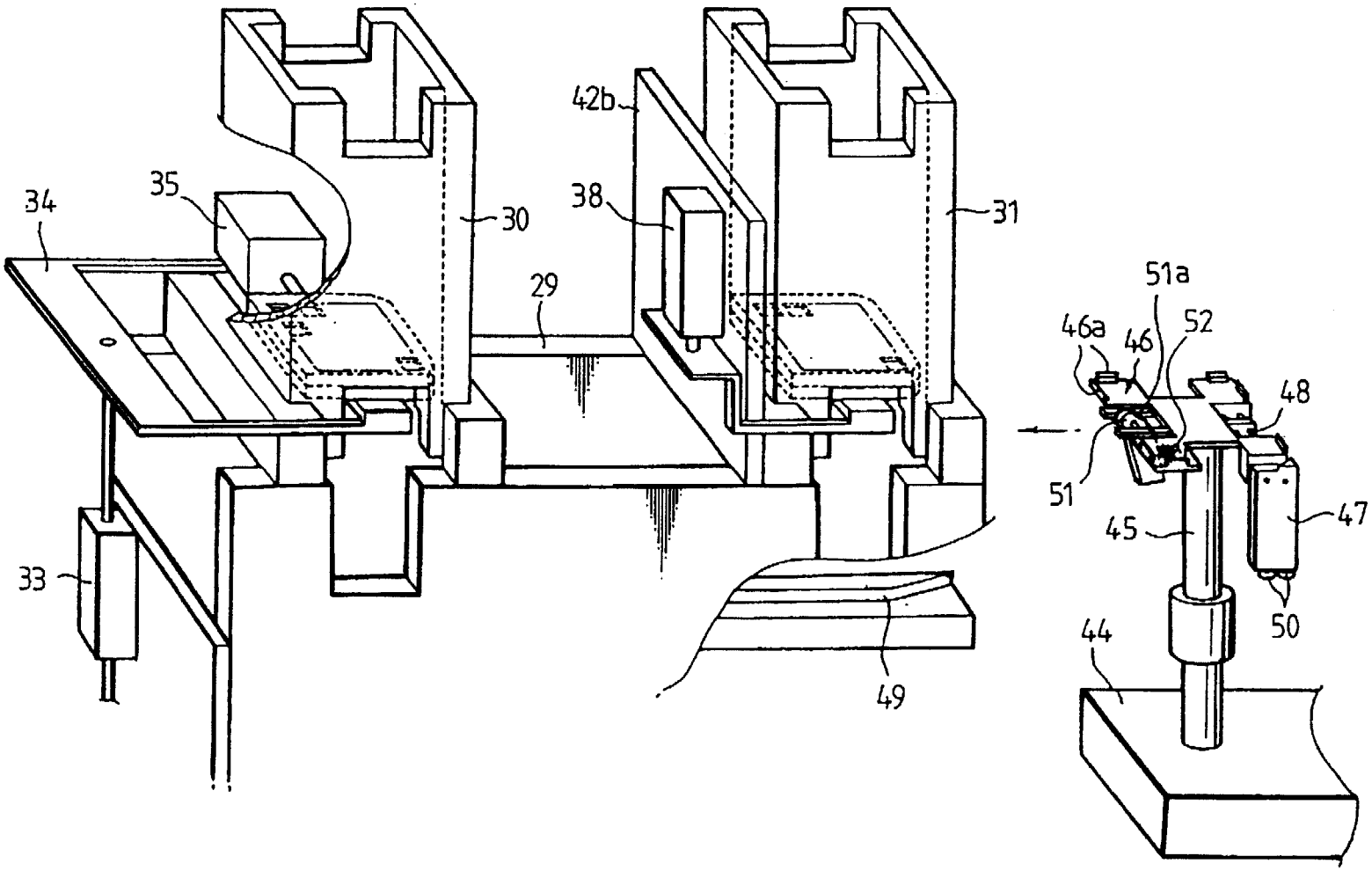
FIG. 7 is a perspective sectional view of the selected components of the apparatus shown in FIGS. 6A, 6B and 6C.

Tray carrying portion 13 for loading empty trays 9 in first magazine 30 and trays with chips **9*a* on second magazine 31 is installed to reciprocate between the chip carrying portion 15 and tray loading/unloading portion 12. The configuration of the tray carrying portion and tray loading/unloading portion is shown in FIG. 7**.

A X-Y robot 44 is installed on base 1. A tray base 46 on which an empty tray 9 (not shown) of the tray loading portion 13 is mounted is fixed to the shaft 45 of the X-Y robot 44. Tray base 46 reciprocates between tray loading/unloading portion 12 and chip carrying portion 15 as the X-Y robot 44 is driven as shown in FIG. 4.

A position determining piece **46*a* for determining the position of empty trays 9 is provided on the top periphery of tray base 46. A clamp 47 for clamping or unclamping an empty tray 9 to be mounted is installed movably on one side of the tray base 46 elastically supported by a coil spring 48. Inside main support 29, that is, the tray loading/unloading portion 12, a guide rail 49 is installed to widen clamp 47 to release a tray 9 or 9*a* in the process of loading/unloading a tray. The lower end of clamp 47 can be in direct contact with guide rail 49. However, it is more desirable that a bearing 50 be coupled to the lower end of clamp 47 so as to be connected to the guide rail 49** in the preferred embodiment of the present invention. This reduces friction resistance and noise.

A sensing piece 51 is installed on one side of tray base 46 as elastically supported by a coil spring 52 so as to be exposed on the top of the tray base 46 and placed inside the position determining piece **46*a*. As an empty tray 9 is mounted on the sensing piece 51, the sensing piece 51 compresses the coil spring 52 and rotates to operate a sensor (not shown). Here, a slope surface 51*a* is formed on the top of the sensing piece 51. This is designed to allow the sensing piece 51 to easily rotate in response to the weight of the empty tray 9 when the empty tray 9 is mounted on the tray base 46 from first magazine 30**.

The modulus of elasticity of coil spring 52 for elastically supporting sensing piece 51 with respect to tray base 46 is determined so that, if an empty tray 9 is not mounted on tray base 46, sensing piece 51 is placed inside position determining piece **46*a*, and that, if the empty tray 9 is mounted on the sensing piece 51, the sensing piece 51 is rotated outward from the position determining piece due to the weight of the empty tray 9**.

Figure 8A:
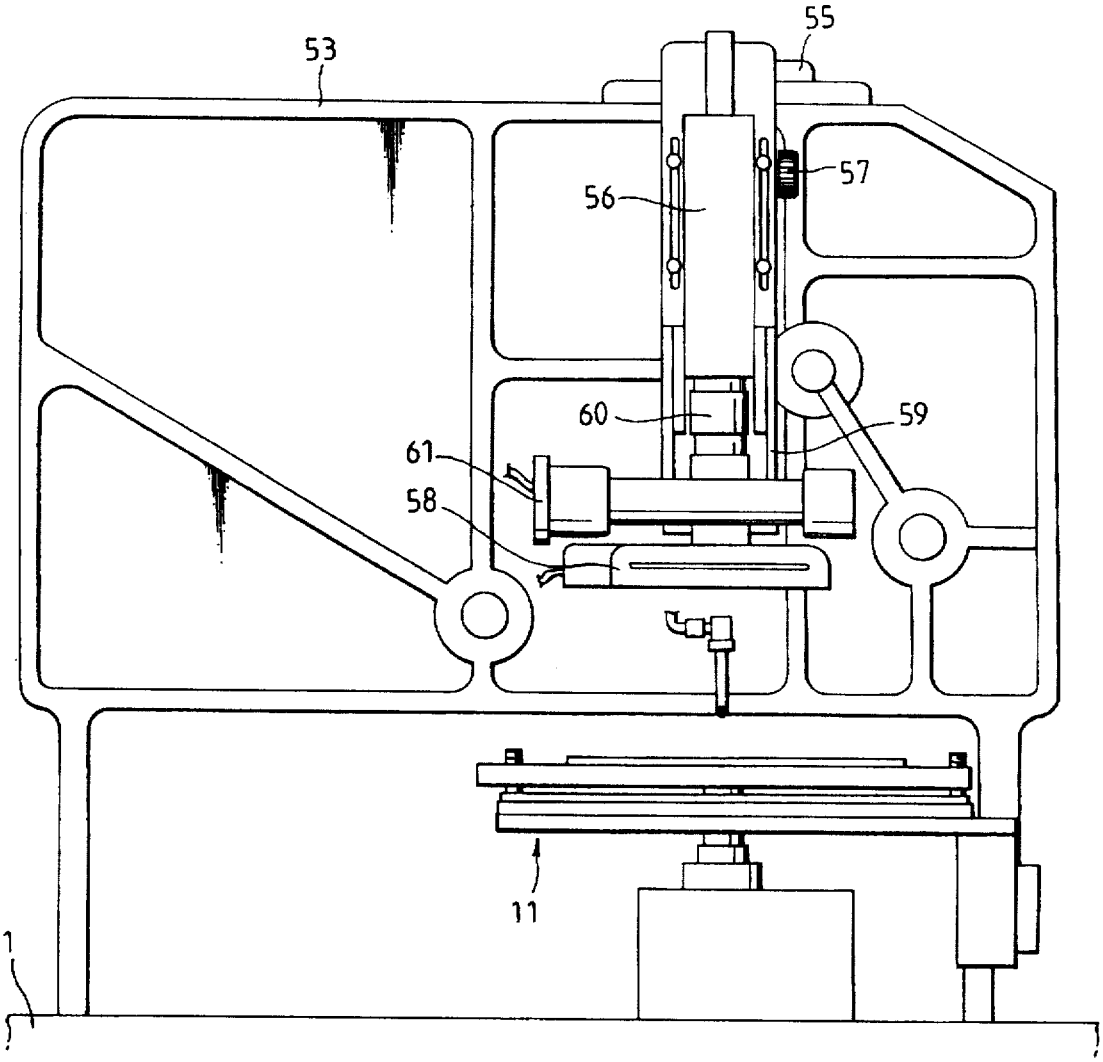
FIGS. 8A and 8B are front and side views of the camera of one preferred embodiment of the present invention.
Figure 8B:
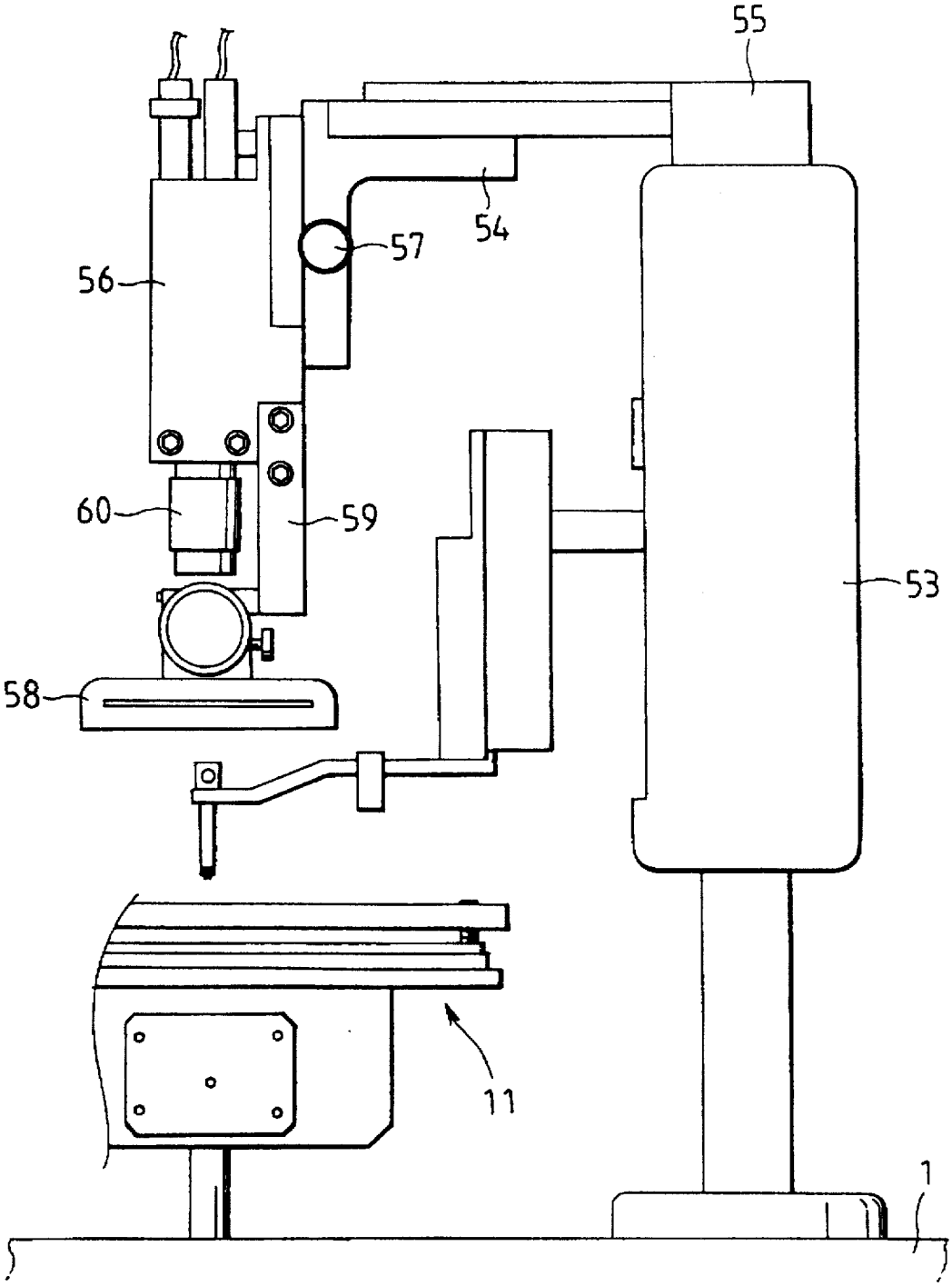

Referring to FIGS. 8A and 8B, a body 53 is fixed to one side of base 1. An adjust mount 54 is secured on the body 53 by a fix mount 55. A camera 56 is provided on the adjust mount 54. Camera 56 is placed directly above the wafer loading portion 11 (as shown in FIG. 3), and move up and down as controlled by a control knob 57. A lamp 58 for applying light toward the wafer 2 when it is discriminated by camera 56 whether a chip is good or bad is secured to camera 56 by a lamp holder 59. Under camera 56 an extend ring 60 for controlling the magnification of the camera is provided. A lamp brightness controller 61 for controlling the brightness of the lamp is installed above the lamp.

Figure 9A:
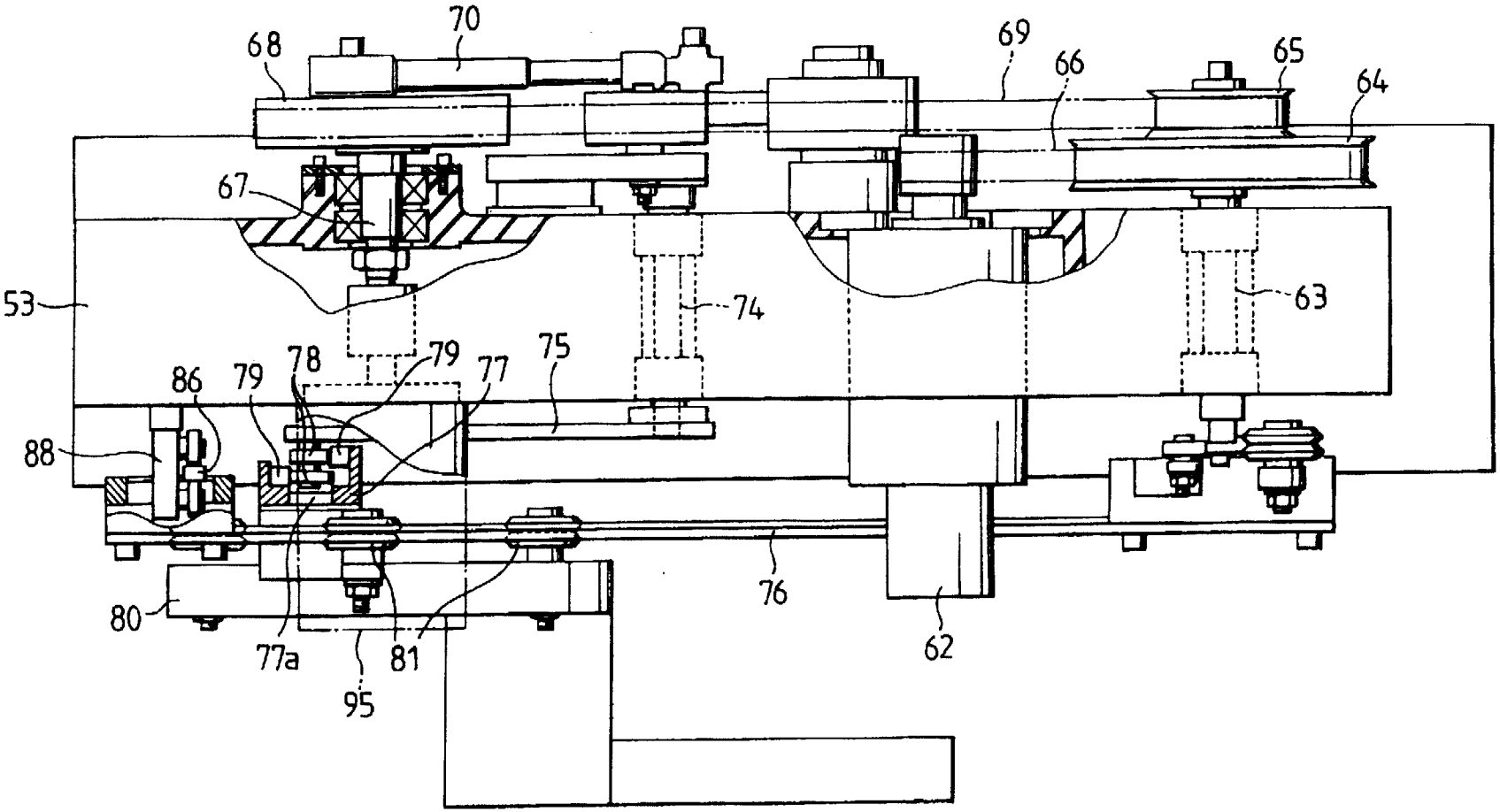
FIGS. 9A, 9B and 9C are plan, front and side sectional views of the chip carrying portion.
Figure 9B:
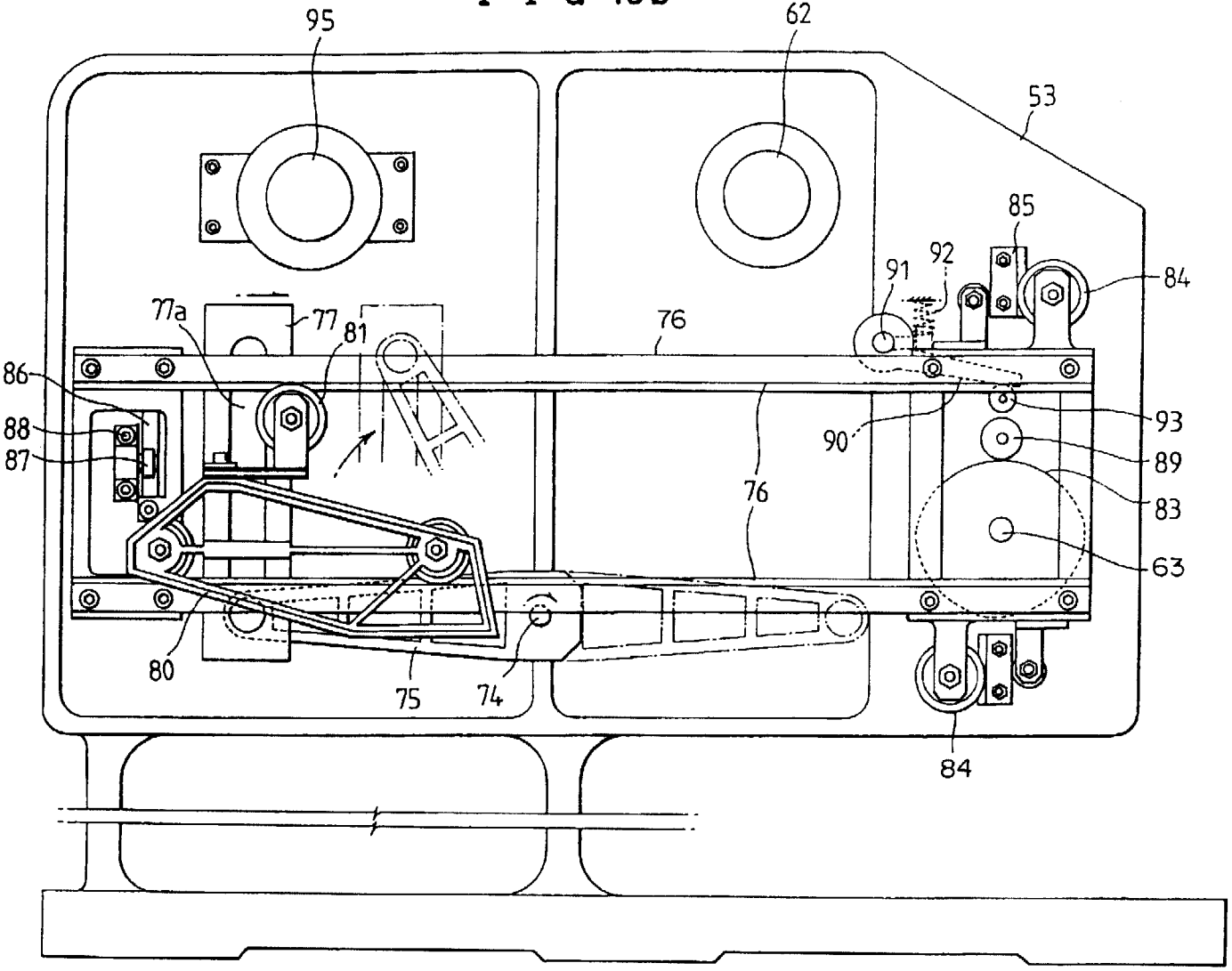
Figure 9C:
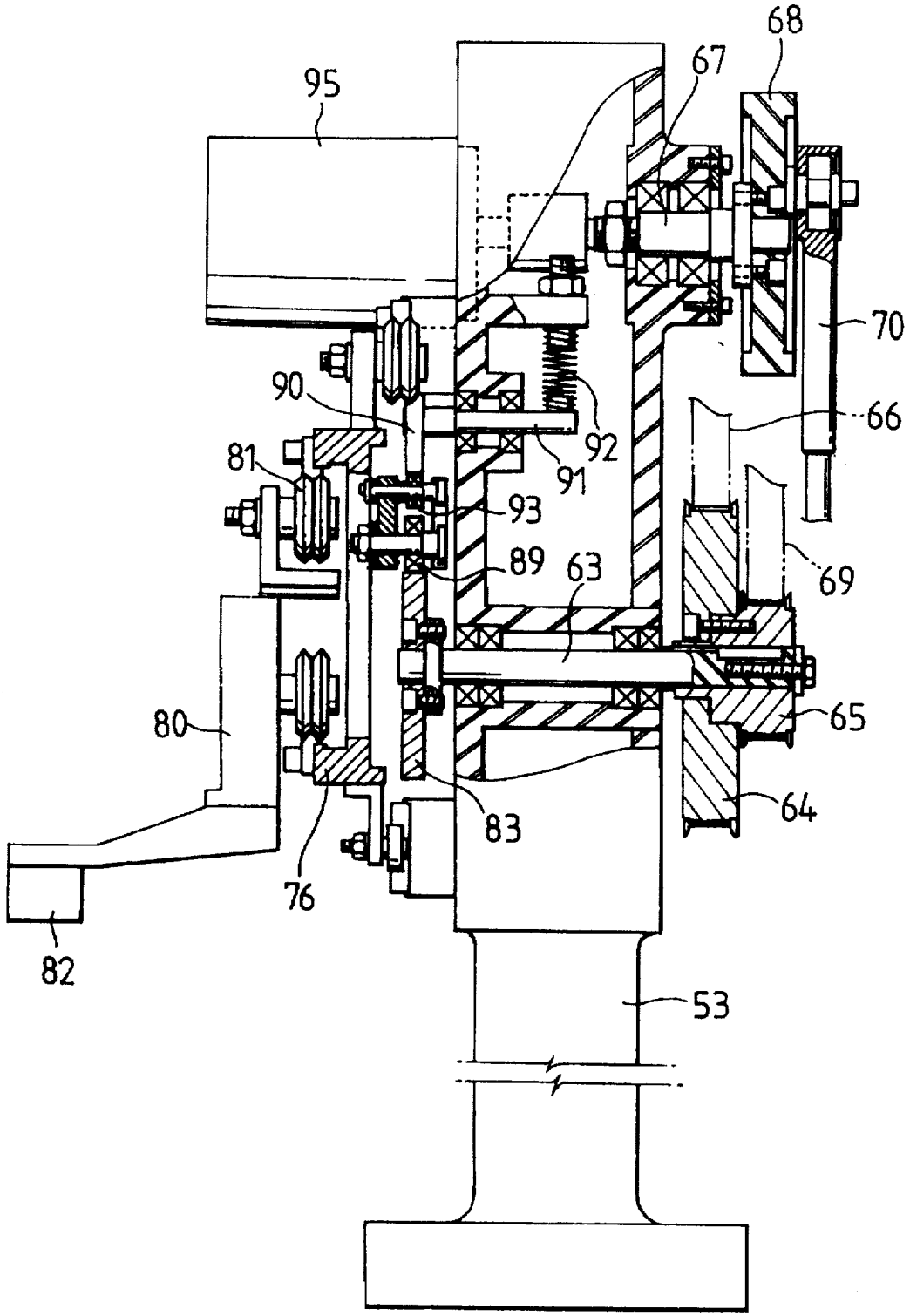
Figure 10:
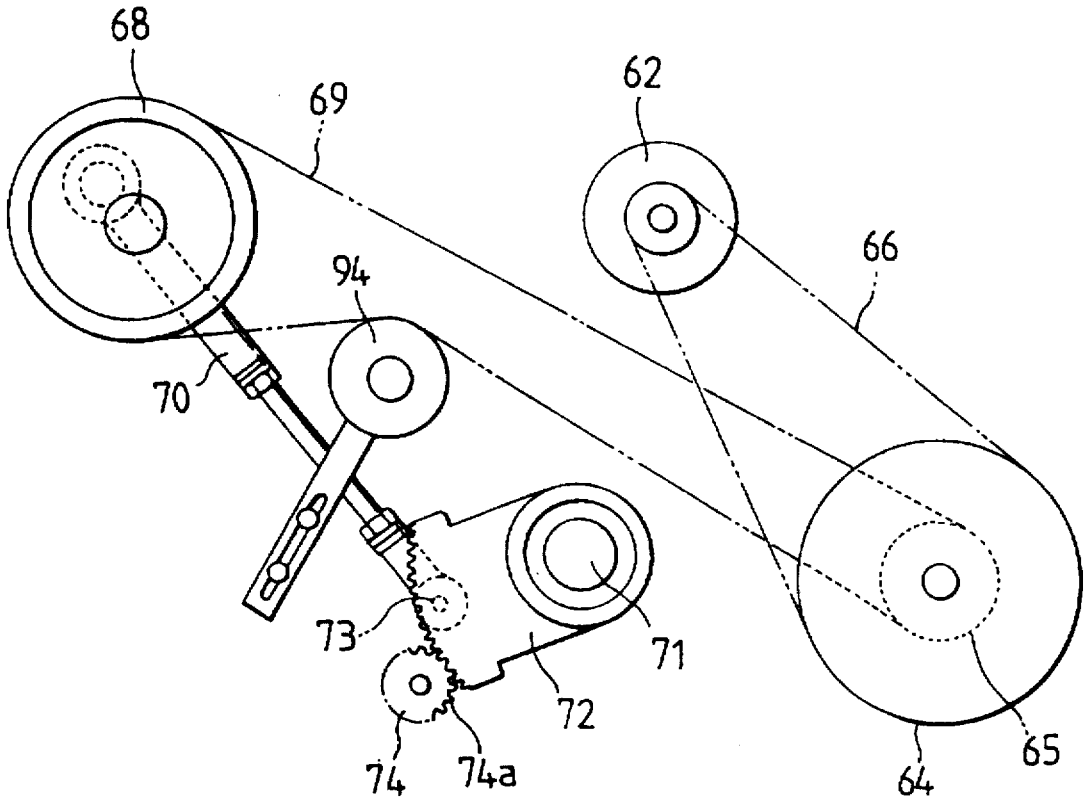
FIG. 10 is a schematic view for explaining the power transmission state of the chip carrying portion.

Referring to FIGS. 9A–10, a servo motor 62 for generating power is secured to one side of body 53. First and second pulleys 64 and 65 are fixed to a first shaft 63 placed on one side of the servo motor 62 so that the shaft of the servo motor 62 and the first pulley 64 are connected by a first timing belt 66. A third pulley 68 is fixed to a fourth shaft 67 so as to be connected to second pulley 65 by a second timing belt 69. As servo motor 62 rotates, first and fourth shafts 63 and 67 rotate in the same direction. A connecting rod 70 is coupled eccentrically to the third pulley 68 secured to the fourth shaft 67, and turns as the third pulley 68 rotates. The other end of the connecting rod 70 is coupled by a pin 73 to a rack gear 72 rocked and centered on second shaft 71.

Rack gear 72 is engaged with a pinion 74*a* formed on one side of third shaft 74. An arm 75 is secured to the other end of the third shaft. The other end of the arm 75 is fitted into a vertical groove 77*a* of a guide piece 77 led by a guide rail 76 and moves laterally. Here, one end of arm 75 can be connected directly to vertical groove 77*a*. However, in order to reduce the tolerance when the arm 75 starts to rotate laterally (at the chip-picking and chip-separating positions), two rollers 78 may be coupled to one end of arm 75, and connection pieces 79 are secured in a crisscross orientation on either side of vertical groove 77*a*. Each of the rollers 78 is connected to a single one of the connection pieces 79, respectively.

A pickup block 80 is secured to one side (toward the wafer loading portion 11) of guide piece 77. A guide roller 81 connected to guide rail 76 is installed above and under the pickup block 80. A pickup 82 for picking and moving the chips from the wafer loading portion 11 by a vacuum pressure is secured to the front end of the pickup block 80. Here, it is desirable that the section of the connection surface of guide rail 76 and guide roller 81 be triangular. This is designed to prevent, in advance, the pickup block 80 from being shaken in the guide rail when the pickup block 80 moves left and right, by increasing the connection surface of the guide rail 76 and guide roller 81.

A cam 83 is secured to one side of first shaft 63 rotating as the servo motor 62 is driven, so that guide rails 76 raise or lower repeatedly corresponding to the difference between the larger diameter and smaller diameter areas of the cam 83. The guide rails 76 are raised or lowered stably by a guide means.

One preferred embodiment of the guide means is as follows. Each of the guide rollers 84 is fixed to one side of one of the guide rails 76. A guide block 85 for guiding one of the guide rails 76 is fixed to body 53. To the other side of the guide rails 76, a raising/lowering piece 86 longer than the raising/lowering distance of the guide rails 76 is fixed. A pair of guide rollers 87 for guiding the raising/lowering piece 86 are supportedly installed on the body 53 by a support piece 88. Here, it is desirable that the section of the connection surface of guide block 85 and guide roller 84 be triangular, similar to that of the connection surface of guide rails 76 and guide roller 81. This is to prevent the guide rails 76 from shaking when they are raised or lowered, by increasing the connection surface of the guide block 85 and guide roller 84. A roller 89 is rotatably coupled to the guide rails 76 via the cam 83, minimizing frictional resistance when the guide rails 76 are raised or lowered by the rotation of the cam 83.

A lever 90 is installed on body 53 and placed adjacent to roller 89 so as to rotate about the center of a shaft 91. Lever 90 always receives a compression force downward from a coil spring 92 fixed to the body 53. On the guide rails 76 in which the end of the lever 90 is placed, another roller 93 is located so as to be connected to the lever 90. This is intended to precisely contain chips picked by pickup 82 in an empty tray 9 by protecting the guide rails 76 from the force of impact when it is lowered due to the roller 89 being connected to the smaller diameter of cam 83.

In order to control the tensile force on the second timing belt 69 for transmitting the force of the servo motor 62 to the third pulley 68, an idle pulley 94 is installed on body 53. The position of this idle pulley 94 can be adjusted. A well-known encoder 95 is installed on one side of the fourth shaft 67 so as to detect the initial position of the pickup 82 and to control other portions, as the fourth shaft rotates.

The operation and effect of the present invention will be described below.

Figure 5A:
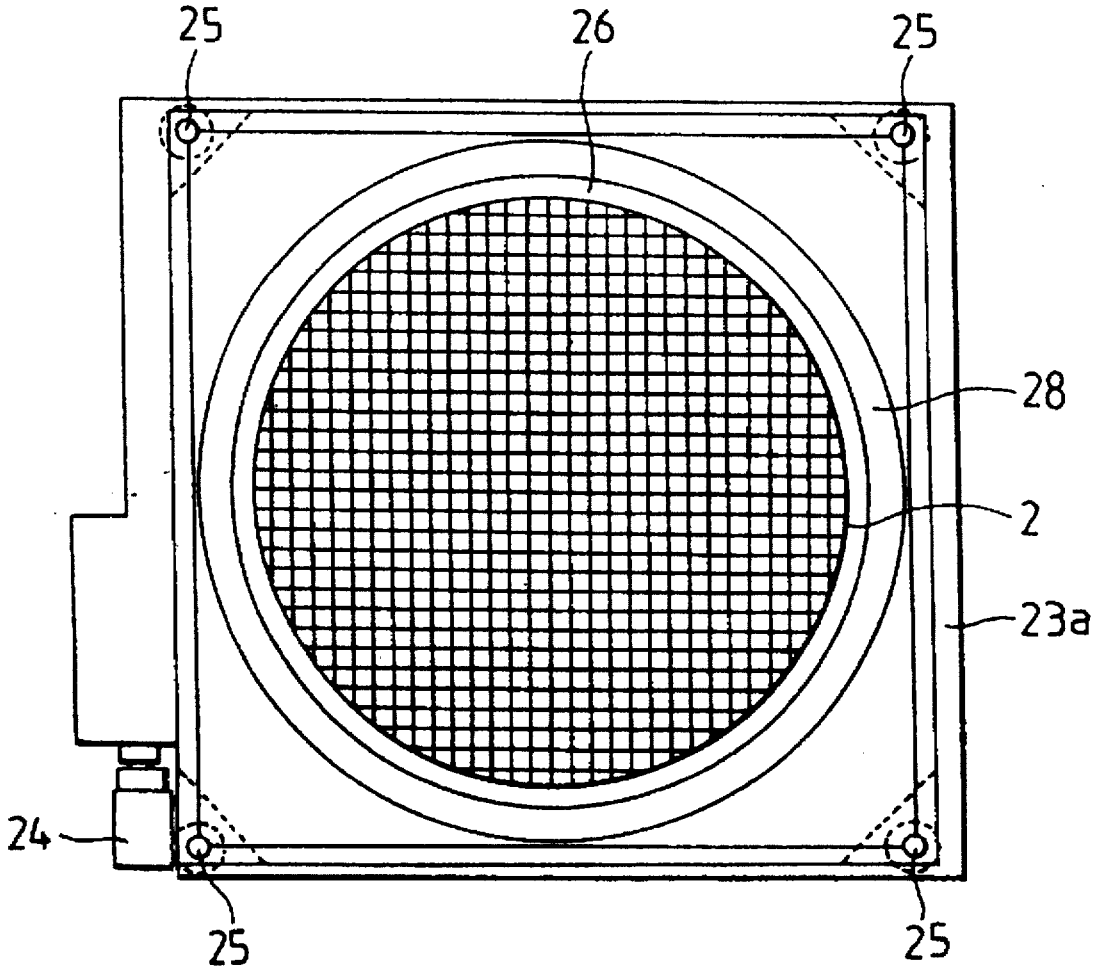
FIGS. 5A, 5B and 5C are plan, front and side views of the wafer loading portion of one preferred embodiment of the present invention, respectively.
Figure 5B:
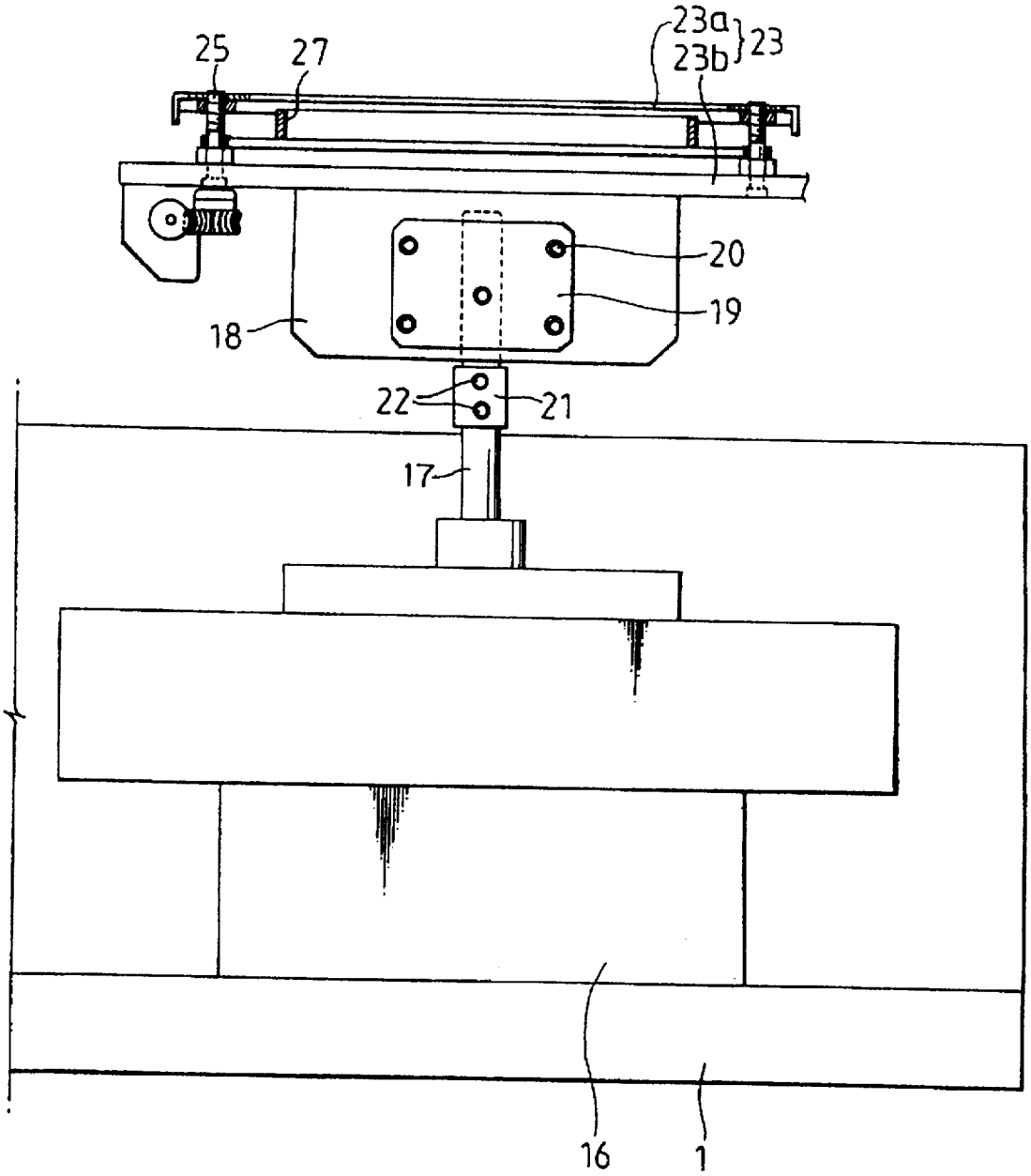
Figure 5C:
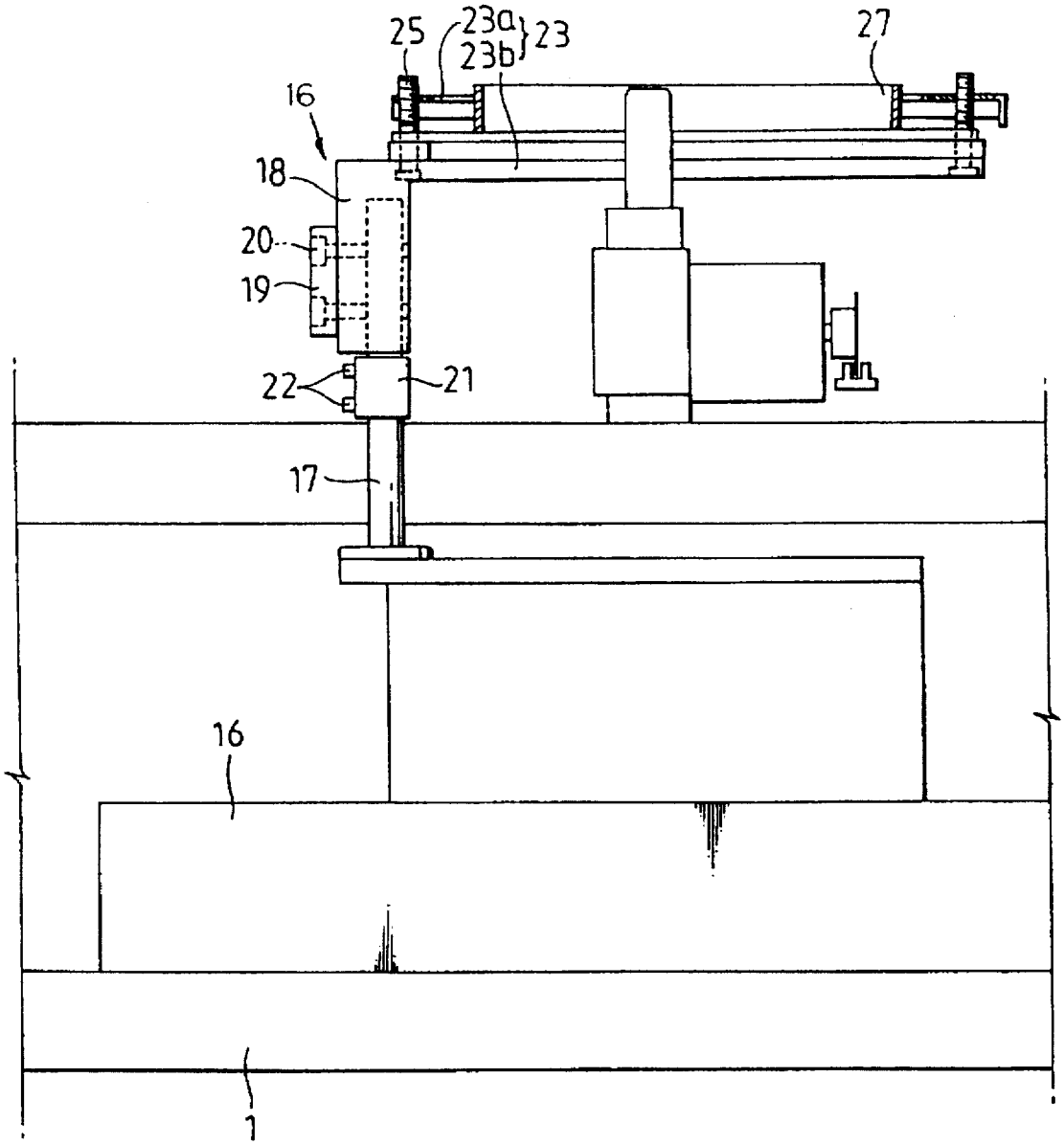

First, as shown in FIGS. 5A, 5B and 5C, wafer 2 as attached onto foil 26 and simultaneously supported by frame 28 is sawed into unit chips. The frame 28 is inserted and fixed between movable expander table 23*a* and expander ring 27, which are included in the wafer loading portion 11.

As step motor 24 is driven and four lead screws 25 coupled to the fixed expander table 23*b* are rotated in the same direction, the movable expander table 23*a* is lowered. As movable expander table 23*a* is lowered, foil 26 placed between movable expander table 23*a* and expander ring 27 is pushed up and expanded by expander ring 27. Here, the foil with sawed chips is connected with the top surface of expander ring 27.

In this situation, as power is applied to controller 96, X-Y robot 44 of the tray carrying portion 13 operates as shown in FIGS. 6A, 6B and 7, so that tray base 46 fixed to shaft 45 moves toward main support 29 of tray loading/unloading portion 12. Clamp 47 coupled to the tray base 46 is connected to guide rail 49. Thus, the clamp 47 elastically supported by the coil spring 48 is widened outward by compressing the coil spring 48.

When clamp 47 coupled to tray base 46 moves while being widened, the tray base 46 is placed under first magazine 30 of the tray loading portion 12, and detected by a detecting means such as a sensor to stop movement of the tray base 46. Third cylinder 35 operates to hold the side of the next to the last empty tray 9. As first cylinder 33 supported by bracket 32 operates, coupling piece 43*a* to which first transfer 34 is fixed, is led by guide block 42*a* and lowered stably so that the lowest empty tray at the bottom of first magazine 30 is lowered while being mounted on the first transfer 34 due to its own weight, and mounted on position determining piece 46*a* above tray base 46.

In this operation, after mounting an empty tray 9 on tray base 46, first transfer 34 is lowered further so as not to interfere with tray base 46 as it moves to the chip loading position. If more than one empty tray is mounted on tray base 46, chips cannot be loaded on the lower empty tray. In this case a pair of opposing sensors 36 located under first magazine 30 detects this situation to stop the operation of the system. Simultaneously, for emergency measure, this situation is indicated to the operator through a buzzer or alarm lamp.

As the lowest empty tray 9 loaded on first magazine 30 is mounted on tray base 46, sensing piece 51 rotates in response to the weight of the empty tray to operate the sensors 35. These sensors 35 detect that the empty tray is mounted, and cause the X-Y robot 44 to return to the initial state. As explained before, since the sloped surface 51*a* is formed on sensing piece 51, the empty tray is easily placed inside position determining piece 46*a* when the empty tray 9 is mounted on the tray base 46. As the sensing piece 51 rotates, coil spring 52 retains its compression force.

After one empty tray 9 held in first magazine 30 is supplied to tray base 46, the first transfer 34 is returned to the initial position by the first cylinder 33. At the same time, third cylinder 35 operates so that the next empty tray 9 held in first magazine 30 is loaded on first transfer 34.

Thereafter, as X-Y robot 44 operates to move tray base 46 near the wafer loading portion 11 (to the chip loading position), clamp 47 escapes from guide rail 49. When clamp 47 escapes from guide rail 49, the clamp 47 returns to the initial state due to the resilience force of coil spring 48. Clamp 47 holds one side of the empty tray so that it is securely held on the tray base 46.

After tray base 46 is carried to the chip loading position, expander table 23 moves on the shaft 17 to a position at which the chips sawed from the wafer are photographed by camera 56. When a chip is regarded as good by camera 56, the expander table 23 stops, and a needle (not shown) is raised to separate the selected chip from the foil 26.

In order to remove the chips separated from the foil using pickup 82, as shown in FIGS. 9A–10, servo motor 62 operates to transmit force to cam 83 which is affixed to first shaft 63 via first timing belt 66. The transmitted force rotates the cam 83 so that roller 89 coupled to guide rails 76 is connected to the smaller diameter of the cam 83. Accordingly, the guide rails 76 arrive at the minimum-range point due to the compression force of lever 90. Here, pickup 82 is positioned above the selected chip so as to pick the chip using the vacuum pressure.

In this operation, guide rails 76 are steadily raised and lowered along guide roller 84, guide blocks 85, raising/lowering pieces 86, and guide rollers 87, one of which being coupled to each guide rail 76. The initial position of the pickup 82 when picking the chips as described above is that arm 75 is placed at a remote position as shown in FIG. 9B as third shaft 74 rotates clockwise.

When the pickup 82 is picking a chip, the servo motor 62 continues to be driven to rotate cam 83. When roller 89 is connected to the larger diameter of the cam, one of the guide rails 76 is raised by compressing coil spring 92 installed elastically with lever 90. By doing so, the chips are separated completely from foil 26. In this operation, the force of servo motor 62 is transmitted to third pulley 68 via second timing belt 69 so that connecting rod 70 eccentrically installed on the third pulley moves rectilinearly. Rack gear 72 connected to the other end of the connecting rod rotates clockwise centering on second shaft 72, while being engaged with pinion 74*a*. Therefore, one end of arm 75 rotates 180° in a counterclockwise direction along vertical groove 77*a* of guide piece 77, centering on third shaft 74. Pickup block 80 fixed to the guide piece is led by pickup block 80 and moves laterally to the tray carrying portion.

When pickup block 80 moves laterally along the guide rollers 81 respectively coupled to guide rails 76 and to the wafer loading portion 11, rollers 78 move to the rear of the arm 75 as connected to connection piece 79 fixed to the right of vertical groove 77*a*. Conversely, when the pickup block 80 moves to the tray carrying portion 13, rollers 78 move to the front of the arm 75. By doing so, the pickup block 80 is raised or lowered along the vertical groove, preventing errors during operation.

When the chips are carried from the wafer loading portion 11 to the tray carrying portion 14, the guide rails 76 do not move and are stationary as the larger diameter of cam 83 rotates while being continuously connected to roller 89. As arm 75 rotates counterclockwise, pickup block 80 moves toward the left as illustrated in FIG. 9*b* and a selected chip as picked by pickup 82 arrives above the depressions of the empty tray, the smaller diameter of the cam 83 begins to engage the roller 89, and the guide rails 76 are narrowed gradually. As cam 83 continues to rotate, the guide rails 76 reach the minimum-range point, and the chips held by the pickup 82 are placed in the depressions of the empty tray 9, the vacuum pressure is released so that the chips held by pickup 82 are positioned in the depressions. As explained above, when pickup 82 picks good chips from the wafer loading portion 11, moves them to the tray carrying portion 14, and secures the selected chips in the depressions of the empty tray 9, rack gear 72 rotates counterclockwise by connecting rod 70. In response, third shaft 74 to which arm 75 is fixed starts to rotate clockwise, to the contrary, returning to the initial position. Through repeated operations, when good chips fill the depressions of the empty tray 9, second cylinder 38 fixedly installed on second magazine 31 operates to lower second transfer 39 secured to coupling piece 43*b*. This is to prevent interference between the lower second transfer 39 and the base 46 as it proceeds toward the second magazine 31.

X-Y robot 44 operates to move tray base 46 fixed to X-Y robot 44 to main support 29 so that clamp 47 coupled to the tray base 46 become connected to guide rail 49 and widens to release the now loaded tray 9*a*.

With clamp 47 being widened, the X-Y robot 44 moves the tray base 46 directly under second magazine 31. The sensor (not shown) detects when the tray base 46 is under the second magazine 31 to stop the X-Y robot 44. Simultaneously, second transfer 39 placed at the minimum-range point is raised by driving second cylinder 38 so that the loaded tray 9*a* mounted on tray base 46 is separated from the tray base 46 by the second transfer 39 and enters second magazine 31. Here, the stop 40 elastically supported by coil spring 41 under second magazine 31 is compressed in order to allow the tray 9*a* to pass. In this state, when the tray escapes from stop 40, the stop 40 is returned to its initial position by the resilience force on the coil spring 41 to receive the next tray in to the second magazine 31 while holding other loaded trays 9*a* in the queue. After the loaded tray 9*a* is placed in second magazine 31, sensing piece 51 rotated by the weight of the loaded tray 9*a* is restored by the resilience force of coil spring 52 to operate the X-Y robot by the sensor 57. X-Y robot 44 moves the tray base 46 directly under the first magazine 30 and stops. Through this operation, a new empty tray 9 at the bottom of the queue in the first magazine can be released and mounted on the tray base 46.

Until now, one cycle of loading chips has been described in which a sawed wafer is loaded on wafer loading portion 11, empty trays 9 are held in first magazine 30, the lowest empty tray 9 of the first magazine is shifted near the wafer loading portion by tray carrying portion 13, chips identified as good using camera 14 only are selected to be contained in the respective depressions of the empty try 9, and the loaded tray 9*a* is held in the second magazine 31. In use, this cycle repeats until all the good chips placed on the wafer loading portion are unloaded, or all the empty trays held in the first magazine are removed.

As described above, many trays 9 may be housed in the first magazine 30 for later automatically loading the trays 9 with chips for storage in the second magazine 31. Such a system enhances productivity as well as enabling automatization of the system.

In addition, the preferred embodiment of present invention places chips precisely in the depressions of an empty tray 9 since the pickup is lowered to engage unit chips placed on the wafer loading portion 11, raised to move laterally to the tray carrying portion 12, and lowered again to be placed above the depressions of the tray.

What is claimed is:

1. An automatic chip-leading apparatus comprising:

a wafer loading means for supporting a wafer having a plurality of chips;

a tray loading/unloading means for disposing a selected tray from a plurality of empty trays and for receiving and storing said selected tray with chips mounted thereon;

the tray loading/unloading means including loading and unloading portions joined together and collectively positioned to one side of the wafer loading means;

a tray carrying means for transporting said selected tray between said tray loading/unloading means and a position adjacent to said wafer loading means;

means for transferring selected chips from said wafer as supported on said wafer loading means onto said selected tray when positioned on said tray carrying means.

2. An automatic chip-loading apparatus as claimed in claim 1, wherein said wafer loading means comprises:

an X-Y robot installed on a base;

a rotatable mount rotatably coupled to a shaft of said X-Y robot;

an expander table positioned on an end of said rotatable mount, the expander table being divided into a movable expander table and a fixed expander table;

means, rotatably coupled to said rotatable mount, for raising and lowering said movable expander table; and an expander ring fixed to said fixed expander table and in contact with a foil on which said wafer is attached, for expanding to separate the chips from the foil when said movable expander table is lowered.

3. An automatic chip loading apparatus as claimed in claim 1, wherein said tray loading/unloading means comprises:

a first magazine having lower and upper portions in which said plurality of empty trays are stacked sequentially, said first magazine having a dispensing end located in the lower portion for dispensing empty trays and a loading end located in the upper portion of the first magazine for continuously receiving empty trays;

a first tray transfer means, positioned adjacent to the dispensing end of said first magazine, for separating said selected tray in said first magazine from the plurality of empty trays;

means, associated with the said first magazine, for holding the plurality of empty trays in the first magazine separately from the selected tray;

a second magazine having lower and upper portions for receiving and storing a plurality of trays with chips mounted thereon, said second magazine having a receiving end located in the lower portion of the second magazine for receiving loaded trays from the tray carrying means and an unloading end located in the upper portion of the second magazine through which loaded trays are continuously removed from the second magazine;

a second tray transfer means installed adjacent to the receiving end of said second magazine for receiving said trays with chips into said second magazine; and said second tray transfer means having a stop for securing trays with chips mounted thereon within said second magazine.

4. An automatic chip-loading apparatus as claimed in claim 3, further comprising:

means for moving said first transfer means for transferring the selected tray from a first loading position adjacent to the dispensing end of the first magazine to a second loading position adjacent to the tray carrying means; and a second transfer means for transferring the selected tray with chips mounted thereon from a first unloading position adjacent to the tray carrying means to a second unloading position at the receiving end of the second magazine.

5. An automatic chip-loading apparatus as claimed in claim 3, wherein said stop is positioned internally within a tray receiving channel of said second magazine.

6. An automatic chip-loading apparatus as claimed in claim 3, further comprising a sensor positioned adjacent to the dispensing end of the first magazine to detect whether more than one empty tray is mounted at one time on said first transfer means.

7. An automatic chip-loading apparatus as claimed in claim 1, wherein said tray carrying means comprises:

a tray base with a tray supporting surface for receiving and carrying said selected tray between said wafer loading means and said tray loading/unloading means;

means for moving said tray base between said tray loading/unloading means and said wafer loading means;

a position determining means provided on the said tray base for determining the position of the selected tray mounted thereon; and means for clamping said selected tray on the tray supporting surface.

8. An automatic chip-loading apparatus as claimed in claim 7, wherein said tray loading/unloading means comprises means for guiding movement of said tray carrying means between said tray loading/unloading means and said wafer loading means, said guiding means including means for widening said clamping means for releasing the selected tray.

9. An automatic chip-loading apparatus as claimed in claim 7, wherein said tray loading/unloading means further comprises a guide rail which said clamping means engages inside said main support for guiding movement of the tray loading/unloading means.

10. An automatic chip-loading apparatus as claimed in claim 9, wherein said clamping means comprises a bearing coupled to an end of said clamping means for connecting said clamping means to said guiding means.

11. An automatic chip-loading apparatus as claimed in claim 7, wherein said tray base further comprises means for detecting the presence of a tray, said detecting means having a sensing piece which rotates in response to the weight of an empty tray and a sensor for sensing the rotation of said sensing piece for detecting the presence of a tray.

12. An automatic chip-loading apparatus as claimed in claim 11, said sensing piece including a sloped surface formed on a surface of said sensing piece.

13. An automatic chip-loading apparatus as claimed in claim 12, wherein said sensing piece is supported elastically by a coil spring supported to urge the sensing piece against the tray base.

14. An automatic chip-loading apparatus as claimed in claim 13, wherein the modulus of elasticity of said coil spring to elastically support said sensing piece is such that if an empty tray is not mounted on said tray base said sensing piece moves to a first position for indicating the absence of a tray to the detecting means, and that, if an empty tray is mounted on said tray base, said sensing piece is rotated to compress the coil spring due to the weight of said empty tray indicating the presence of a tray to the detecting means.

15. An automatic chip-loading apparatus as claimed in claim 1, wherein said chip carrying portion comprises:

a body fixedly positioned on said base;

a servo motor fixed to said body and for generating power;

a cam fixed to a first shaft rotating in response to said servo motor;

a guide rail positioned on said body and connected to said cam, for reciprocal movement in response to rotation of said cam;

guiding means for guiding said guide rail;

a connecting rod which turns in response to said servo motor;

a rack gear coupled to an end of said connecting rod to a second shaft for rectilinear movement;

a third shaft formed with a pinion engaged with said rack gear for converting the rectilinear movement of said connecting rod into a rotational movement within a range of 0° to 180°;

an arm having an end secured to said third shaft, and another end led by said guide rail and fitted into a vertical groove of a guide piece for reciprocal movement;

a pickup block to which a first guide roller is fixed to said guide piece and connected to a first and second surface of said guide rail for movement laterally along with said guide piece within the rotation range of said arm as said arm rotates; and a pickup fixed to the front end of said pickup block and for picking and moving chips.

16. An automatic chip-loading apparatus as claimed in claim 15, wherein a guide block is fixed by said guide means on one side above and under said body, a second guide roller connected to said guide block is coupled to said guide rail, a pair of third guide rollers are supportedly installed on the other side of said body by a support piece so as to be placed in the middle of said guide rail, and a raising/lowering piece is fixed to said guide rail to be fitted between said third guide rollers.

17. An automatic chip-loading apparatus as claimed in claim 16, wherein said guide block and second guide roller share a connecting surface that is triangular in section.

18. An automatic chip-loading apparatus as claimed in claim 15, further comprising a first roller rotatably coupled to said guide rail for urging said roller against said cam.

19. An automatic chip-loading apparatus as claimed in claim 18, further comprising a lever for urging said first roller against said cam.

20. An automatic chip-loading apparatus as claimed in claim 19, further comprising a second roller on said guide rail so that one end of said lever is urged against said roller.

21. An automatic chip-loading apparatus as claimed in claim 15, wherein said guide rail has a connection surface between the guide rail and the first guide roller that has a triangular shaped cross section.

* * * * *